US009351597B2

(12) United States Patent
Liu et al.

(10) Patent No.: US 9,351,597 B2
(45) Date of Patent: May 31, 2016

(54) LID FOR BEVERAGE CONTAINER

(71) Applicants: THERMOS L.L.C., Schaumburg, IL (US); THERMOS K.K., Nigata-ken (JP)

(72) Inventors: Zhenjun Liu, Niigata-ken (JP); Shin Matsuyama, Niigata-ken (JP)

(73) Assignee: Thermos L.L.C., Schaumburg, IL (US)

( * ) Notice: Subject to any disclaimer, the term of this patent is extended or adjusted under 35 U.S.C. 154(b) by 0 days.

(21) Appl. No.: 14/637,026

(22) Filed: Mar. 3, 2015

(65) Prior Publication Data

US 2015/0250340 A1 Sep. 10, 2015

(30) Foreign Application Priority Data

Mar. 4, 2014 (JP) ..... 2014-041829

(51) Int. Cl.

| | |
|---|---|
| ***B65D 43/12*** | (2006.01) |
| ***A47G 19/22*** | (2006.01) |
| ***B65D 47/28*** | (2006.01) |
| ***B65D 43/02*** | (2006.01) |
| ***B65D 43/20*** | (2006.01) |
| ***B65D 51/24*** | (2006.01) |
| ***B65D 47/32*** | (2006.01) |

(52) U.S. Cl.

CPC ..... *A47G 19/2272* (2013.01); *B65D 43/02* (2013.01); *B65D 43/20* (2013.01); *B65D 47/286* (2013.01); *B65D 47/32* (2013.01); *B65D 51/248* (2013.01); *B65D 2251/0018* (2013.01); *B65D 2251/0081* (2013.01); *B65D 2543/00046* (2013.01)

(58) Field of Classification Search

CPC .... A47G 19/2272; B65D 43/20; B65D 43/02; B65D 51/248; B65D 2251/0018; B65D 2251/0081; B65D 2543/00046

USPC ..... 220/254.9, 345.1, 715; 222/559

See application file for complete search history.

(56) References Cited

U.S. PATENT DOCUMENTS

| | | | | |
|---|---|---|---|---|
| 4,057,167 | A | 11/1977 | Lee | |
| 4,819,829 | A * | 4/1989 | Rosten et al. | 220/345.3 |
| 5,368,186 | A | 11/1994 | Yeh | |
| 5,462,189 | A | 10/1995 | Pierce | |
| 6,439,442 | B1 | 8/2002 | Markert et al. | |

(Continued)

FOREIGN PATENT DOCUMENTS

| | | |
|---|---|---|
| JP | 59-159548 A | 9/1984 |
| JP | 09-002545 A | 1/1997 |

(Continued)

OTHER PUBLICATIONS

EP 15157387.0 Search Report mailed Jul. 31, 2015 (7 pages).

*Primary Examiner* — Fenn Mathew
*Assistant Examiner* — James N Smalley
(74) *Attorney, Agent, or Firm* — Polsinelli PC

(57) ABSTRACT

A lid for a beverage container includes: a cap main body that adheres to an upper aperture part of a beverage container main body and includes a liquid through-hole, and a sliding cap that is installed on the cap main body in a detachable manner by engaging in a sliding manner, and that opens and closes the liquid through-hole by sliding, an elastic clicking part is provided on side surfaces of the sliding cap, clicking reception parts are formed in the cap main body, and the sliding cap is held by the cap main body when the elastic clicking part engages with the clicking reception parts.

8 Claims, 7 Drawing Sheets

(56) References Cited

U.S. PATENT DOCUMENTS

| | | | |
|---|---|---|---|
| 6,752,287 | B1 | 6/2004 | Lin |
| 7,584,843 | B2 | 9/2009 | Kutsch et al. |
| 2012/0080429 | A1 | 4/2012 | Steininger |
| 2012/0312816 | A1 | 12/2012 | Barreto et al. |

FOREIGN PATENT DOCUMENTS

| | | | |
|---|---|---|---|
| JP | U 3136174 | B | 10/2007 |
| JP | U 3137750 | B | 12/2007 |
| JP | 2008-179406 | A | 8/2008 |
| WO | 2008063037 | A1 | 5/2008 |

* cited by examiner

LID FOR BEVERAGE CONTAINER

CROSS REFERENCE TO RELATED APPLICATION

This application claims the benefit of Japanese Patent Application No. 2014-041829 filed Mar. 4, 2014, which is hereby incorporated by reference in its entirety.

FIELD OF THE INVENTION

The present invention relates to a lid for a beverage container such as a metal vacuum thermal insulating tumbler.

BACKGROUND OF THE INVENTION

Examples of lid opening and closing structures of beverage containers of the related art are disclosed in Japanese Utility Model (Registered) Publication No. 3136174 and Japanese Utility Model (Registered) Publication No. 3137750. In Japanese Utility Model (Registered) Publication No. 3136174, a lid is disclosed in which an opening and closing part that performs opening and closing of a drinking opening by means of flapping rotation is axially mounted, but the opening and closing part is axially attached using a rotational shaft, and since it is not possible to separate the opening and closing part from the lid, cleaning of the axial attachment part is difficult. In addition, since a mechanism is not provided that maintains the opening and closing part in a state in which the drinking opening is open, there is a problem in that the opening and closing part closes during drinking of a beverage inside the container.

In Japanese Utility Model (Registered) Publication No. 3137750, a lid is disclosed that performs opening and closing of a drinking opening by rotating a moveable cap in a horizontal manner with the center of the lid as the pivot point thereof, but the moveable cap cannot be separated from the lid, and therefore, cleaning a gap between the lid and the moveable cap is difficult. In addition, since there is no mechanism that fixes the moveable cap, maintaining the moveable cap in a predetermined position is difficult. Furthermore, since a liquid through-hole is further on an inner side than an outer circumferential surface of the lid, there are circumstances in which liquid remains without being drank.

SUMMARY OF THE INVENTION

A lid for a beverage container is described. The lid can separate the entirety of constituent members of the lid from each other, and thereby improving cleaning properties.

In addition, another lid for a beverage container is described. The lid includes a sliding cap having an elastic clicking structure, and thereby improving manipulation properties.

In addition, another lid for a beverage container is described. The lid includes a liquid through-hole on an outer circumferential surface, and liquid does not remain after drinking.

In addition, another lid for a beverage container is described. The lid includes a cap main body that attaches to an upper aperture part of a beverage container main body and includes a liquid through-hole. The lid includes a sliding cap that is installed on the cap main body in a detachable manner by engaging in a sliding manner. The sliding cap opens and closes the liquid through-hole by sliding. An elastic clicking part is provided on side surfaces of the sliding cap. Clicking reception parts are formed in the cap main body. The sliding cap is held by the cap main body when the elastic clicking part engages with the clicking reception part.

Another lid for a beverage container is described. The lid includes the elastic clicking part formed by notching a part of the side surface of the sliding cap.

Another lid for a beverage container is described. The lid includes a notched part formed on a back surface of the sliding cap, and a positioning projection provided in the cap main body. The positioning projection passes through the notched part when the sliding cap engages with the cap main body. However, in a case in which the sliding cap is accidentally reversed, the engagement between the sliding cap and the cap main body in a sliding manner is not possible due to the positioning projection interfering with the sliding cap.

Another lid for a beverage container is described. The lid includes the liquid through-hole to open toward an outer side of the cap main body.

Another lid for a beverage container is described. The lid includes a cap main body that attaches to an upper aperture part of a beverage container main body and includes a liquid through-hole. The lid includes a sliding cap that is installed on the cap main body in a detachable manner by engaging in a sliding manner. The sliding cap opens and closes the liquid through-hole by sliding to cover the liquid through-hole. The lid includes elastic projections that are provided on side surfaces of the sliding cap. The lid includes reception notches that are formed in the cap main body. The sliding cap is held by the cap main body when the elastic projections engage with the reception notches.

Another lid for a beverage container is described. The elastic projections emit an audible sound, a vibration, and/or a tactile sensation when the elastic projections engage with the reception notches.

In addition, a beverage container is also described. The beverage container includes any of the lids above.

The lids described herein provide advantages. As described above, the sliding cap is detachable, and it is possible to improve cleaning properties. In addition, when the elastic clicking part formed in the sliding cap engages with the clicking reception part formed in the cap main body, it is possible to reliably maintain the sliding cap in a predetermined position.

Further, since there is a space surrounding a protruding part that is formed on a side surface of the sliding cap, it is possible to make the protruding part elastic, and therefore, it is possible to reliably perceive a clicking feeling when the clicking part engages with the clicking reception part.

Further, since a front wall of the sliding cap interferes with an incorrect insertion prevention projection that is formed in the cap main body when an attempt to install the sliding cap backwards is made, it is possible to prevent incorrect insertion of the sliding cap.

Further, the liquid through-hole is open at the outer periphery of the lid, and therefore, it is possible to detach the sliding cap by sliding the sliding cap via the open part. In addition, it is possible to completely drink a beverage inside the beverage container without liquid remaining.

DETAILED DESCRIPTION OF THE INVENTION

A lid for a beverage container will be described with reference to the appended drawings. The embodiments that are described below do not limit the content of the present disclosure. In addition, all of the configurations that are described below are not necessarily essential requirements of the lid for a beverage container of the present disclosure.

Example 1

FIGS. 1 to 9 show a lid for a beverage container of Example 1. A lid 3 for a beverage container covers an upper aperture part 2 of a beverage container main body 1 that has a metal vacuum thermal insulating structure.

Figure 1:
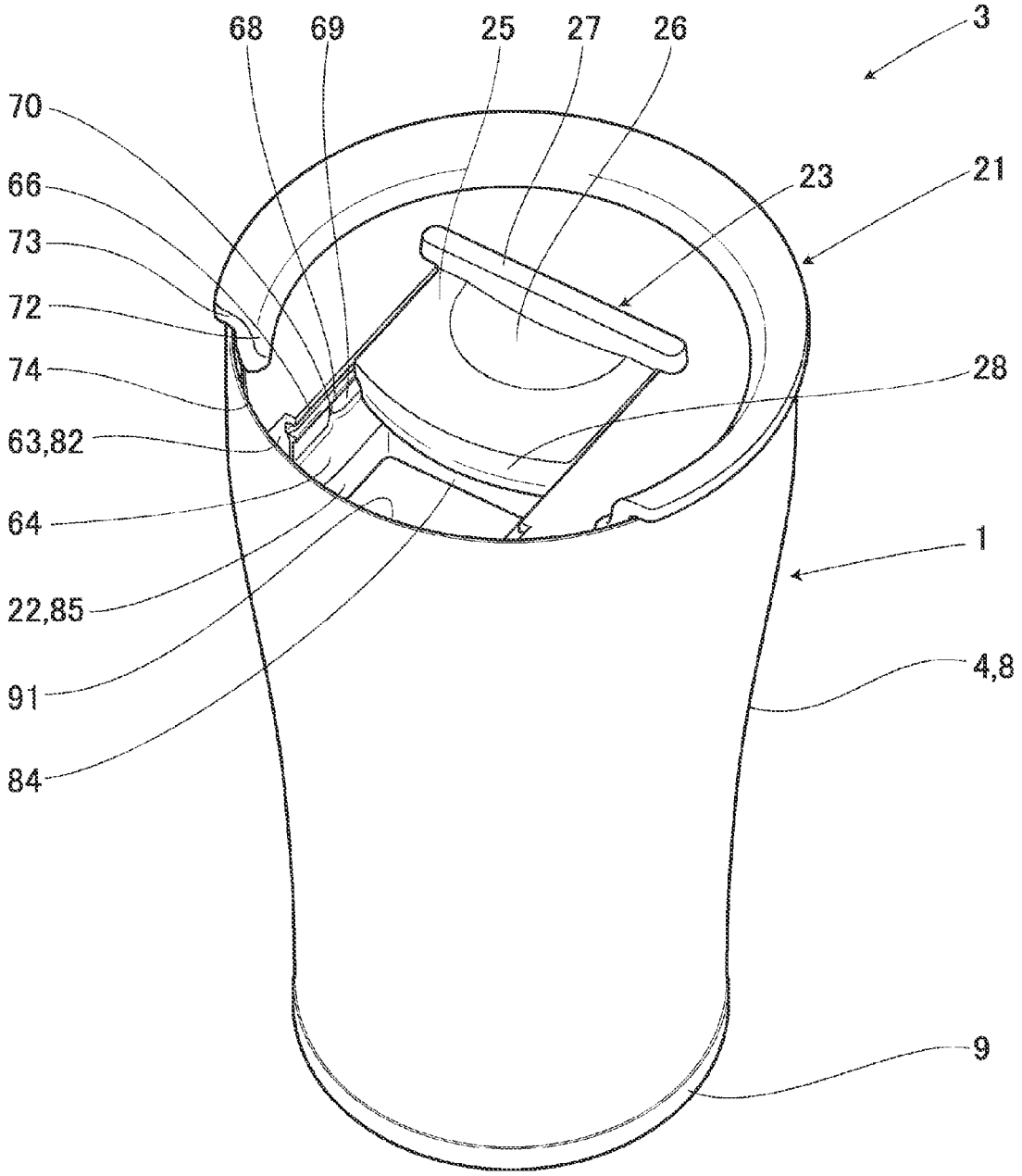
FIG. 1 is a perspective view of a lid for a beverage container and a beverage container according to Example 1 of the present disclosure.
Figure 2:
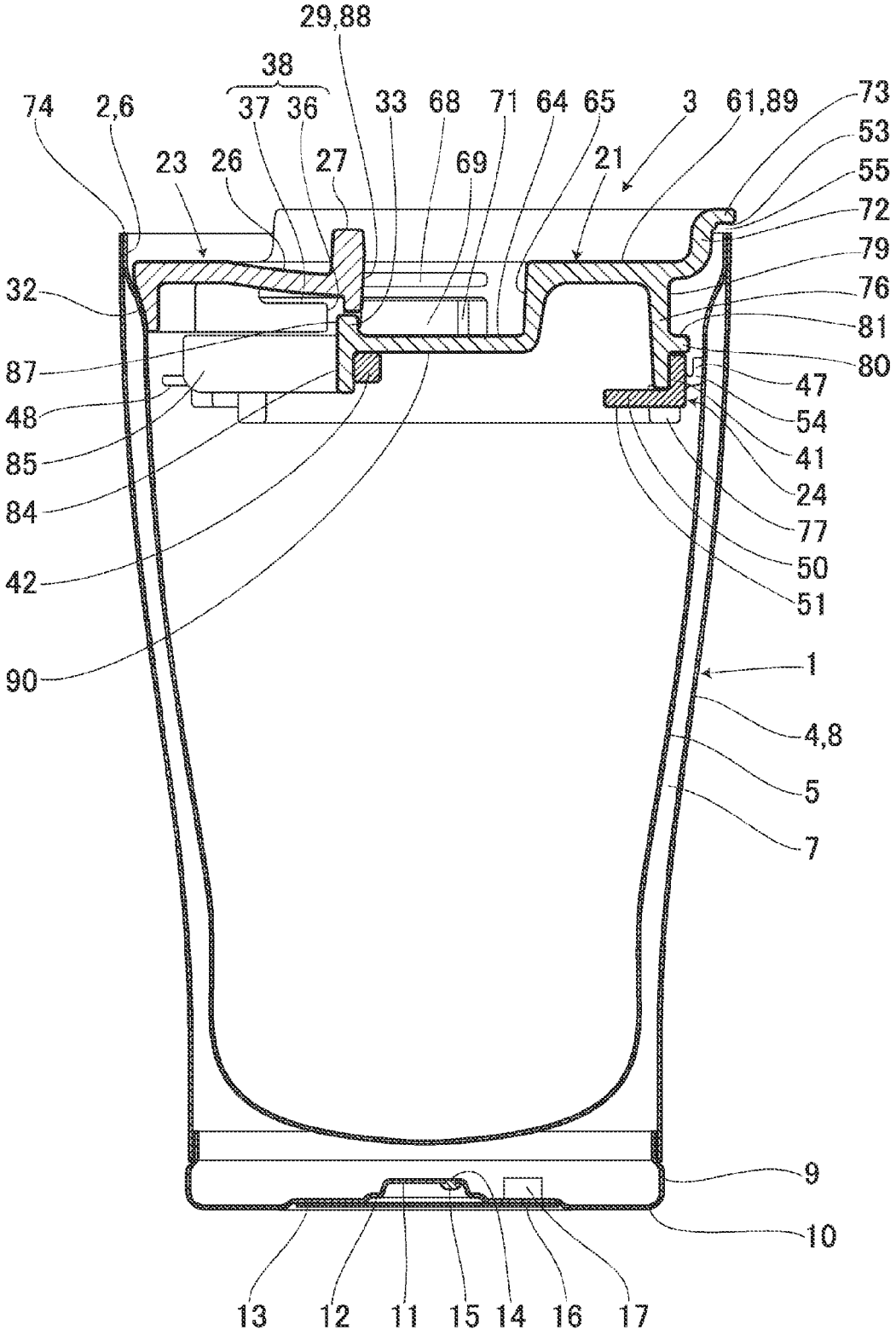
FIG. 2 is a longitudinal cross-sectional view of the lid and the beverage container that are shown in FIG. 1.

As shown in FIGS. 1 and 2, the beverage container main body 1 is configured from an outer container 4 that has a bottomed cylindrical shape in which an upper part is open, and an inner container 5 that has a bottomed cylindrical shape in which an upper part is open in the same manner, and is arranged in the outer container 4. The outer container 4 and the inner container 5 are joined in an integral manner by being welded at a position of an upper aperture part 6, and a vacuum thermal insulating layer 7 is formed between the outer container 4 and the inner container 5. Additionally, the outer container 4 and the inner container 5 are both formed by stainless steel (for example, SUS304).

The outer container 4 has a two-member structure that is formed from a tubular cylindrical part 8 in which the top and bottom are open, and a shallow bottomed cylindrical bottom part 9 that is joined to a lower part of the cylindrical part 8 by welding. A three-stage structure vertical stepped part is formed on a bottom surface 10 of the bottom part 9 with concentric circles. The stepped part is configured from an upper stepped part 11 that is formed in a central part of the bottom surface 10, a middle stepped part 12 that is formed with a larger diameter than the upper stepped part 11 at an outer peripheral side of the upper stepped part 11, and a lower stepped part 13 that is formed with a larger diameter than the middle stepped part 12 at an outer peripheral side of the middle stepped part 12.

In addition to a small ventilation hole 14, a vacuum sealing material 15 that seals the ventilation hole 14 is arranged in the upper stepped part 11. The ventilation hole 14 is in communication with an area between the outer container 4 and the inner container 5, and the vacuum thermal insulating layer 7 is formed between the outer container 4 and the inner container 5 when sealing the ventilation hole 14 with the vacuum sealing material 15 after ventilating the area using the ventilation hole 14. Additionally, for example, as the vacuum sealing material 15, a brazing metal material that is formed from Sn, and an alloy of Sn and Ag, Cu, Ni, Bi or Zn, or a brazing glass material is used.

A thin disc-shaped protective plate 16 that protects the vacuum sealing material 15 from external impacts and the like is installed on the lower stepped part 13. The protective plate 16 is formed by the stainless steel in the same manner as the outer container 4 and the inner container 5, and is installed on the lower stepped part 13 using a heat-resistant adhesive or the like.

In addition, a degasser 17 that adsorbs gas that is generated from inside the vacuum thermal insulating layer 7 is arranged on a surface of the lower stepped part 13 on the vacuum thermal insulating layer 7 side. Additionally, as long as the degasser 17 is not in a position that blocks the ventilation hole 14, the degasser 17 may be arranged at any location inside the vacuum thermal insulating layer 7.

The inner container 5 has a one-member structure, a longitudinal cross-sectional of which has a substantial U-shape, and portions thereof other than connection portions of the aperture part 6 do not abut against the outer container 4 in a state where the inner container 5 is accommodated inside the outer container 4.

Figure 3:
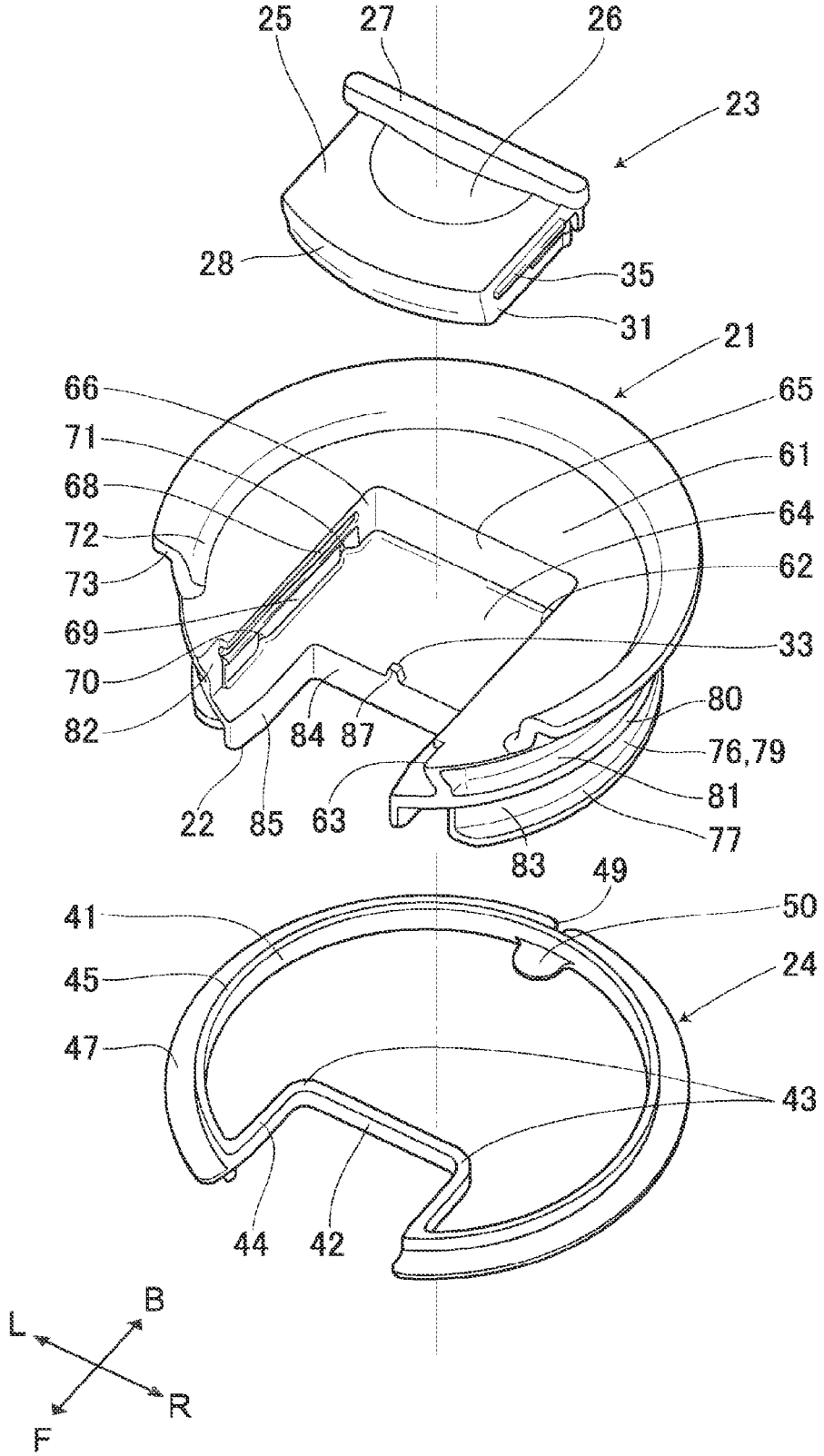
FIG. 3 is an exploded perspective view of a sliding cap, a cap main body, and a liquid stopping member that are shown in FIG. 1.
Figure 4:
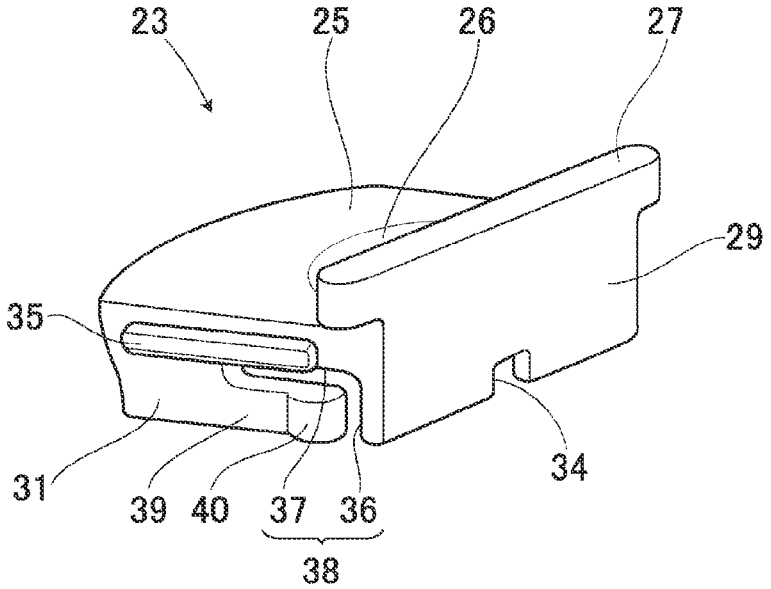
FIG. 4 is a perspective view of the sliding cap that is shown in FIG. 1.
Figure 5:
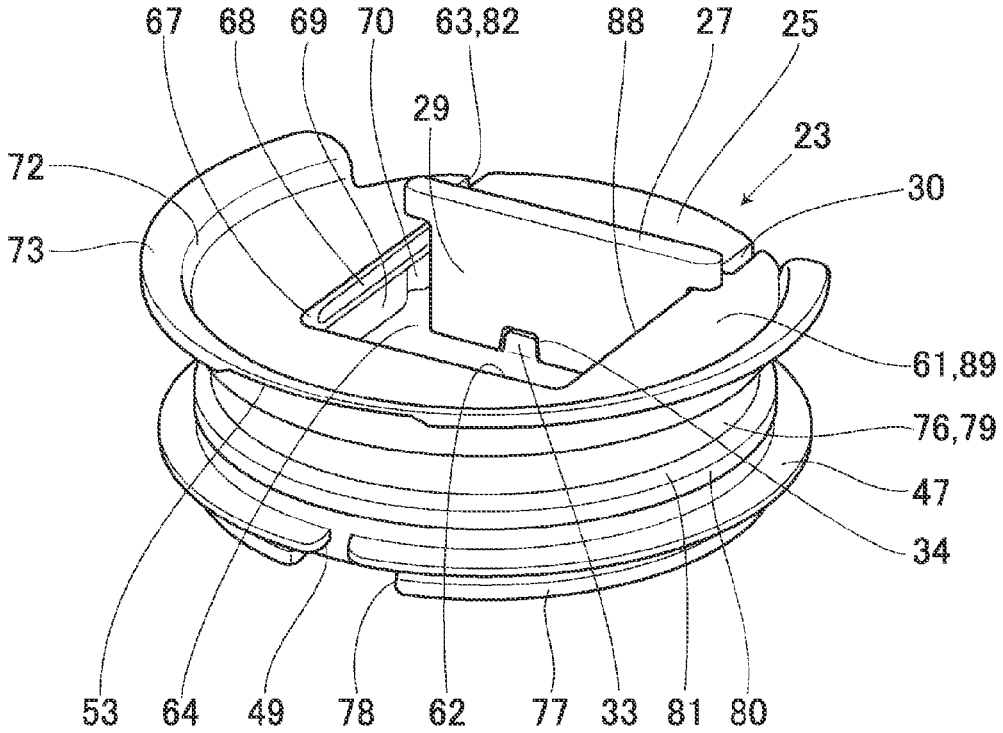
FIG. 5 is a perspective view of correct installation of the sliding cap that is shown in FIG. 1.

Hereinafter, the lid 3 will be described in detail. In the description, an F arrow direction that is shown in FIG. 3 is set as a front side of the lid 3, a B arrow direction is set as a back side of the lid 3, an L arrow direction is set as a left side of the lid 3, and an R arrow direction is set as a right side of the lid 3.

The lid 3 is configured from a cap main body 21 that covers the upper aperture part 2 of the beverage container main body 1, a sliding cap 23 that opens and closes a liquid through-hole 22 that is formed in the cap main body 21, and a liquid stopping member 24. The sliding cap 23 and the liquid stopping member 24 are easily attachable and detachable with respect to the cap main body 21, and can be washed and dried separately. Additionally, the liquid stopping member 24 is a so-called non-metallic seal that is formed by a synthetic rubber such as a silicon rubber.

The sliding cap 23 has a small flat plate part 25 in which the front side has an arc shape that is convex in a front direction, and the back side, the left side and the right side are linear. A semicircular shallow concave part 26 that is convex in the front direction is formed on the back side of an upper surface of the small flat plate part 25. The shallow concave part 26 is positioned at the center of the product in plan view, is a portion that a finger abuts against when holding a manipulation bar 27, which will be described later, and is for facilitating holding of the manipulation bar 27.

The manipulation bar 27 which is vertically arranged in an upward manner is formed on an end surface of the back side of the small flat plate part 25. The width of the manipulation bar 27 in a left-right direction is larger than the width of the small flat plate part 25 in the left-right direction. In other words, both the left and right ends of the manipulation bar 27 protrude further in the left-right direction than the small flat plate part 25, and both the left and right ends have an R shape in plan view. A user can perform opening and closing of the liquid through-hole 22 that is formed in the cap main body 21 by holding the manipulation bar 27 with a finger and sliding the sliding cap 23.

In addition, a front wall 28 that is vertically arranged from a front side end part in a downward manner, a back wall 29 that is vertically arranged from a back side end part in a downward manner, a left wall 30 that is vertically arranged from a left side end part in a downward manner, and a right wall 31 that is vertically arranged from a right side end part in a downward manner are formed in the small flat plate part 25, and the vertical positions of the respective lower ends thereof are uniform. As a result of this, it is possible to mount the sliding cap 23 in a stable manner. In addition, a space that is surrounded by the front wall 28, the back wall 29, the left wall 30, and the right wall 31 is formed on a lower side of the small flat plate part 25.

The front wall 28 is inclined toward a back side toward the bottom thereof. In contrast to this, a diameter of an inner surface part 32 of the inner container 5 is gradually decreased toward the bottom thereof, the inner surface part 32 abutting against the front wall 28 in a state in which the lid 3 is installed on the beverage container main body 1, and the liquid through-hole 22 is closed, that is, a state in which the sliding cap 23 has been slid to the front side. As a result of this, the inclination portion of the front wall 28 and the inclination portion of the inner surface part 32 are made to correspond and abut against one another.

An incorrect insertion prevention notched part 34 for allowing an incorrect insertion prevention projection 33 to pass therethrough during engagement of the sliding cap 23 with the cap main body 3 is formed in a central part of a lower end of the back wall 29. The incorrect insertion prevention notched part 34 is substantially rectangular, and has a size that can allow the incorrect insertion prevention projection 33, which will be described later, to pass therethrough.

A sliding engagement rib 35 that protrudes in a horizontal manner to the left side is formed on the left wall 30 in a front-back direction. In addition, a notched part 38 is formed on the left wall 30 below the sliding engagement rib 35 on the back side of the left wall 30. The notched part 38 is formed from a vertical notched part 36 in which the left wall 30 has been notched in a top-bottom direction, and a horizontal notched part 37 in which the left wall 30 has been notched to the front side from an upper end of the vertical notched part 36, and the vertical notched part 36 and the horizontal notched part 37 are connected in a perpendicular manner. A clicking rib 40 that is convex to an outer side is formed at a leading end of an arm-shaped elastic part 39 that is formed by the notched part 38. Due to the notched part 38 being formed in the periphery of the elastic part 39, the flexibility of the elastic part 39 in the left-right direction is improved. Moreover, the clicking rib 40 is used as a clicking part in this embodiment. However, the clicking part may be a protrusion, projection, extension, etc. that is biased outward from the main body of the sliding cap. In addition, the clicking rib 40 is formed by forming the notched parts 38 in the right and left wall 30 and 31 in this embodiment, but the clicking part can also be formed by forming a protrusion or a projection made of material which a user can perceive a clicking feeling on the right and left walls 30 and 31. The clicking part on the sliding cap may also be a protrusion or projection having resiliently flexible or spring actuation.

A sliding engagement rib 35, a notched part 38, and a clicking rib 40 are formed in the right wall 31 in the same manner as the left wall 30, and respectively face the sliding engagement rib 35, the notched part 38, and the clicking rib 40 that are formed in the left wall 30.

The liquid stopping member 24 includes a ring-shaped ring part 41, a part of the front side of which has been notched, and a U-shaped part 42 that is connected to a portion of the ring part 41 that is notched, is concave in an inside direction of the ring part 41, and which has a smooth bottom surface in plan view. The inner peripheries and outer peripheries of two curved parts 43 that are formed in the U-shaped part 42 that has a smooth bottom surface are rounded. In addition, an upper side surface 44 of the U-shaped part 42 that has a smooth bottom surface is flush with a ring part upper surface 45, which is an upper side surface of the ring part 41. A lower side surface 46 of the U-shaped part 42 that has a smooth bottom surface is flush with a tongue piece part lower surface 48, which is a lower side surface of a tongue piece part 47, which will be described later.

In addition, the thin plate-shaped tongue piece part 47 that protrudes in the horizontal direction is formed in the center in the top-bottom direction of an outside side surface of the ring part 41. Further, a tongue piece notched part 49 that is narrowly notched is formed on the back side of the tongue piece part 47 for air flow. In addition, a substantially semicircular thin plate-shaped back part tab 50 that is convex toward the front side is formed on an back side inner surface of the ring part 41. A back part tab lower surface 51, which is a lower side surface of the back part tab 50, is flush with a ring part lower surface 52, which is a lower side surface of the ring part 41. Additionally, the tongue piece notched part 49 need not necessarily be narrowly notched, and may have a hole shape through which air can pass.

The cap main body 21 includes a flat plate part 61 that is substantially circular in plan view, and a sliding engagement part 62 with which the sliding cap 23 engages is formed on a central part in the left-right direction, which is the front side of the flat plate part 61. The sliding engagement part 62 has a substantially rectangular shape that is concave toward the bottom, and a front side of which is open. In addition, the length in the front-back direction of the sliding engagement part 62 is longer than the radius of the flat plate part 61, and the length in the left-right direction is substantially the same as the radius of the flat plate part 61. In addition, a wide aperture part 63, the width of which is wide in the left-right direction, is formed on a front side end part of the sliding engagement part 62.

The substantially rectangular liquid through-hole 22, which is in communication with the inside of the beverage container main body 1, is formed in a bottom surface part 64, which is a bottom surface of the sliding engagement part 62. The front side of the liquid through-hole 22 is open, the length in the front-back direction of the liquid through-hole 22 is less than or equal to half of the length of the sliding engagement part 62 in the front-back direction, and the length in the left-right direction of the liquid through-hole 22 is shorter than the length of the sliding engagement part 62 in the left-right direction. In addition, a front side end part of the liquid through-hole 22 is made gradually wider toward the front side direction thereof.

The sliding engagement part 62 is formed from the bottom surface part 64, a back side wall 65, which is a wall on the back side, a left side wall 66, which is a wall on the left side, and a right side wall 67, which is a wall on the right side. The back side wall 65, the left side wall 66, and the right side wall 67 are respectively vertically arranged to be perpendicular from the bottom surface part 64. In a state in which the liquid through-hole 22 is completely open, that is, a state in which the sliding cap 23 has been slid as far as possible to the back side, the back side wall 65 abuts against the back wall 29 of the sliding cap 23.

An upper sliding groove 68 along which the sliding engagement rib 35 that is formed in the sliding cap 23 slides is formed in the left side wall 66. In addition, a lower sliding groove 69 along which the clicking rib 40 that is formed in the sliding cap 23 slides is formed below the upper sliding groove 68. The upper sliding groove 68 is formed so that a groove width thereof in the top-bottom direction is narrower than that of the lower sliding groove 69. In addition, the upper sliding groove 68 is formed so that a groove depth thereof is deeper than that of the lower sliding groove 69.

Concave parts for maintaining engagement of the sliding cap 23 at predetermined positions are formed in the lower sliding groove 69 at two locations. When the clicking rib 40 is engaged with a front clicking reception part 70, which is a concave part of the front side, the sliding cap 23 completely closes the liquid through-hole 22. When the clicking rib 40 is engaged with a back clicking reception part 71, which is a concave part of the back side, the sliding cap 23 completely opens the liquid through-hole 22, that is, the back wall 29 of the sliding cap 23 abuts against the back side wall 65 of the cap main body 21. The concave parts are formed as the clicking reception parts 70 and 71 in this embodiment. However, a notch, indention, groove, etc. that receives the clicking part can also be used as the clicking reception part.

A state in which the clicking rib 40 is engaged with the front clicking reception part 70, will be referred to as a closed state of the sliding cap 23, and a state in which the clicking rib 40 is engaged with the back clicking reception part 71, will be referred to as an open state of the sliding cap 23.

An upper sliding groove 68, a lower sliding groove 69, a front clicking reception part 70, and a back clicking reception part 71 are formed in the right side wall 67 in the same manner as the left side wall 66, and respectively face the upper sliding groove 68, the lower sliding groove 69, the front clicking reception part 70, and the back clicking reception part 71 that are formed in the left side wall 66 in the same manner as the left side wall 66.

A distance between the left and right clicking ribs 40 and 40 is longer than a distance between the left and right lower sliding grooves 69. Therefore, when the left and right clicking ribs 40 and 40 respectively slide along the left and right lower sliding grooves 69, the left and right elastic parts 39 are respectively biased toward the inside. Further, when the clicking rib 40 moves to a position of the front clicking reception part 70 and the back clicking reception part 71, the biasing toward the elastic part 39 is released, and the clicking rib 40 is engaged.

An upper wall 72 that is vertically arranged in an upward manner is formed on an upper surface outer circumferential part of the flat plate part 61, and a container reception part 73 that protrudes horizontally to the outer side is formed at an upper end of the upper wall 72. In addition, when the lid 3 is installed on the beverage container main body 1, positioning of the lid 3 with respect to the beverage container main body 1 is performed by an upper end surface 74, which is an end surface of the upper side of the beverage container main body 1, abutting against a container reception part lower surface 75, which is a lower side surface of the container reception part 73. The upper wall 72 and the container reception part 73 are not formed in the wide aperture part 63 of the sliding engagement part 62 but in a certain portion on both sides thereof. As a result of this, it is possible to drink a beverage inside the beverage container main body 1 by putting one's mouth on the beverage container main body 1.

In addition, a stepped part for air flow 53 is formed on the back side of the container reception part lower surface 75 by making the thickness of the container reception part 73 thin for air flow. The front side of the stepped part for air flow 53 is formed in a linear manner, and the back side thereof is formed in an arc shape since the back side runs along the outer periphery of the container reception part 73.

A lower wall 76 that is vertically arranged in a downward manner is formed slightly closer to the center than an outer periphery of a lower surface of the flat plate part 61, and a cap main body lower end part 77 that protrudes horizontally to an outer side thereof is formed at a lower end of the lower wall 76. The front sides of the lower wall 76 and the cap main body lower end part 77 are open with the same width as the wide aperture part 63 of the sliding engagement part 62, and a rectangular tab disposition part 78 for disposing the back part tab 50 that is formed in the liquid stopping member 24 is formed on the back side. In addition, a thin plate-shaped groove formation wall 80 that protrudes in a horizontal manner to an outer side is formed in a central part in the top-bottom direction of an outer side surface 79 of the lower wall 76. A groove formation wall upper surface 81, which is an upper side surface of the groove formation wall 80, is obstructed by an opening part wall 82 that is vertically arranged from the bottom surface part 64, and forms the wide aperture part 63, and is flush with the bottom surface part 64 of the sliding engagement part 62.

A groove-shaped liquid stopping member engagement part 83 for engaging the liquid stopping member 24 is formed between the cap main body lower end part 77 and the groove formation wall 80.

The liquid through-hole 22 opens a front side end part of the sliding engagement part 62. The liquid through-hole 22 is formed by a hole back wall 84, which is a wall on the back side of the sliding engagement part 62 that is vertically arranged downward from the bottom surface part 64 of the sliding engagement part 62, a hole left wall 85, which is a wall of the left, and a hole right wall 86, which is a wall of the right side. Each lower end of the hole back wall 84, the hole left wall 85, and the hole right wall 86 is positioned above the cap main body lower end part 77. The U-shaped part 42 of the liquid stopping member 24 that has a smooth bottom surface is engaged along the external surfaces of each wall of the hole back wall 84, the hole left wall 85, and the hole right wall 86.

The incorrect insertion prevention projection 33 for preventing a circumstance in which the sliding cap 23 is mistakenly installed backwards is formed in a central part in the left-right direction of the front of the bottom surface part 64. The incorrect insertion prevention projection 33 is cuboid being convex to the top, and a front side surface part 87, which is a surface of the front side, is flush with the hole back wall 84 of the liquid through-hole 22.

In this instance, the installation of the sliding cap 23 onto the cap main body 21 will be described in detail.

Firstly, the sliding cap 23 is pushed from the back wall 29 along the wide aperture part 63 of the cap main body 21 so that the sliding cap 23 slides in a horizontal manner. At this time, a position in the top-bottom direction of the sliding cap 23 is adjusted so that the engagement ribs 35 slides along the upper sliding groove 68 and the clicking rib 40 slides along the lower sliding groove 69. Further, when the sliding cap 23 is pushed further along the sliding engagement part 62 of the cap main body 21, the incorrect insertion prevention notched part 34 allows the incorrect insertion prevention projection 33 to pass therethrough, the clicking rib 40 becomes engaged with the front clicking reception part 70 that is formed in the lower sliding groove 69, and the sliding cap 23 is maintained in the cap main body 21 in a position in which the liquid through-hole 22 is completely closed. At this time, a disc-shaped lid upper surface 89 that has a rectangular concave part 88 concave to the bottom at the center thereof in plan view is formed by the flat plate part 61 of the cap main body 21 and the small flat plate part 25 of the sliding cap 23. Since the lid upper surface 89 is circular, it is suitable for covering the upper aperture part 2 of the beverage container main body 1 that is circular in plan view.

When the sliding cap 23 is pushed further along the sliding engagement part 62 of the cap main body 21, the liquid through-hole 22 gradually opens, and the back wall 29 of the sliding cap 23 abuts against the back side wall 65 of the cap main body 21. In a position in which the back wall 29 abuts against the back side wall 65, the clicking rib 40 is engaged with the back clicking reception part 71, and the sliding cap 23 is maintained in a closed state. Additionally, in a case in which the sliding cap 23 is detached, the sliding cap 23 may be drawn out from the wide aperture part 63 through sliding to the front side.

When the clicking rib 40 is engaged with the front clicking reception part 70 and the back clicking reception part 71, a user can perceive a clicking feeling, an audible sound, a vibration, and/or a tactile sensation. As a result of the recoil when the biasing of the elastic part 39 is released, therefore, it is possible to recognize that the clicking rib 40 is engaged with the front clicking reception part 70 and the back clicking reception part 71.

In addition, since the sliding cap 23 is designed so that the elastic part 39 does not deform due to the weight of the sliding cap 23 when the sliding cap 23 is in an open state or a closed state, even if the beverage container is inclined during use, it is possible to use the beverage container without worrying about the sliding cap 23 opening and closing automatically.

Furthermore, when the sliding cap 23 is in a position between the open state and the closed state, the elastic part 39 is in an elastically deformed state of being biased against an inner side, and the sliding cap 23 maintains the position thereof due to the elasticity of the elastic part 39. Therefore, even if the beverage container is inclined, the sliding cap 23 does not slide automatically. Therefore, by adjusting an opening amount of the liquid through-hole 22 arbitrarily by sliding the sliding cap 23, the user can adjust an amount of beverage that flows out via the liquid through-hole 22.

Figure 6:
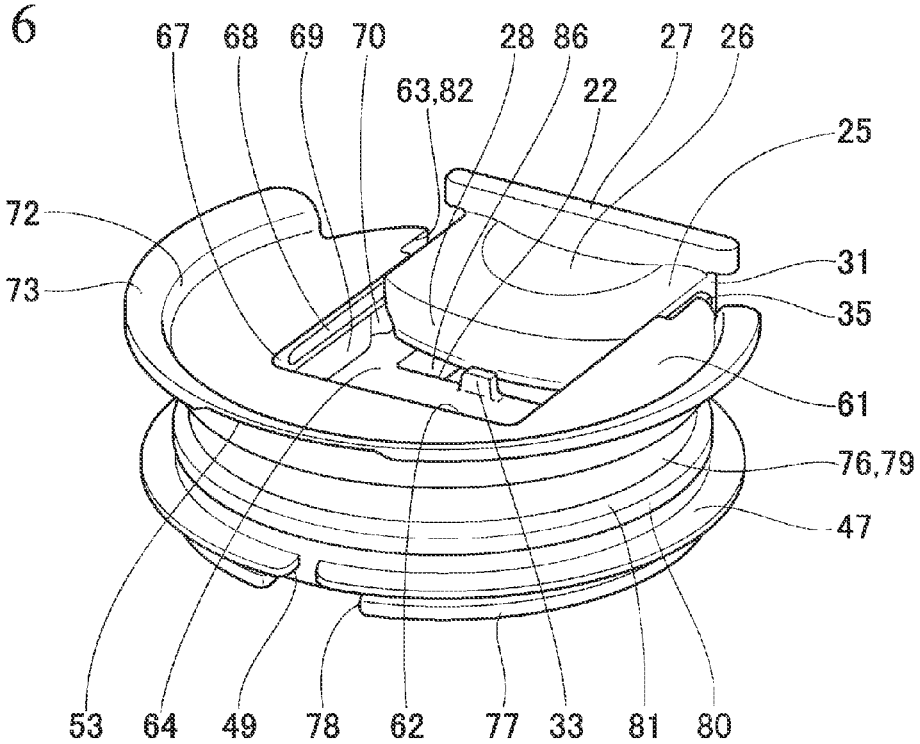
FIG. 6 is a perspective view of incorrect installation of the sliding cap that is shown in FIG. 1.
Figure 7:
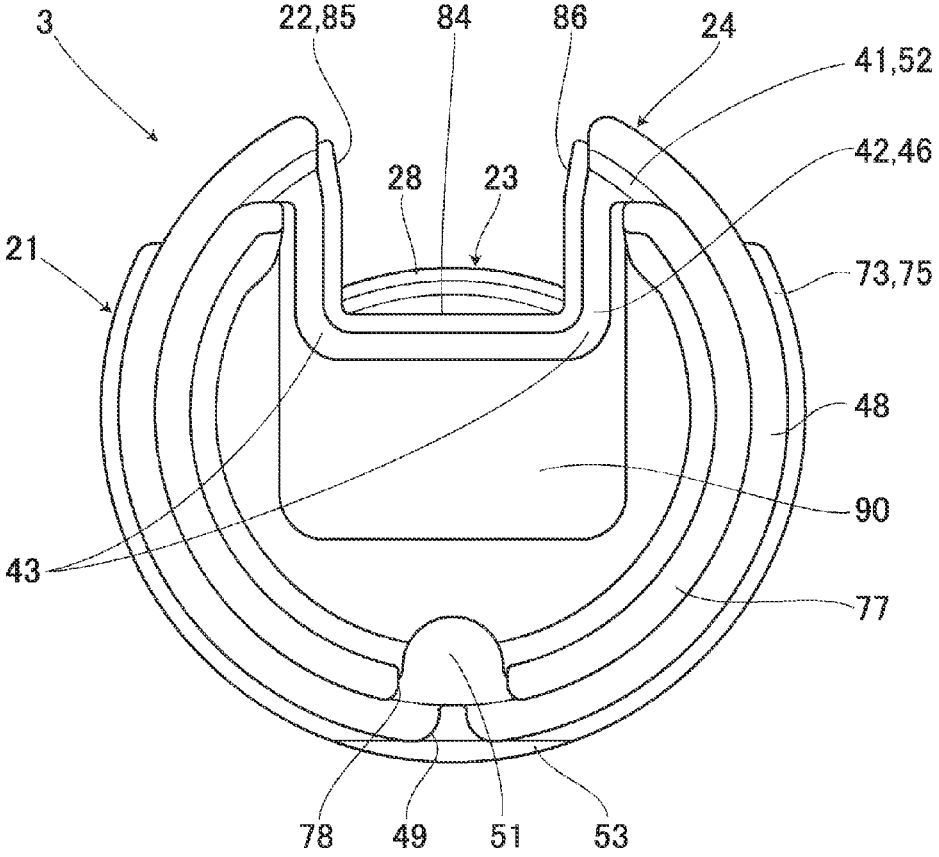
FIG. 7 is a bottom view of the lid that is shown in FIG. 1.
Figure 8:
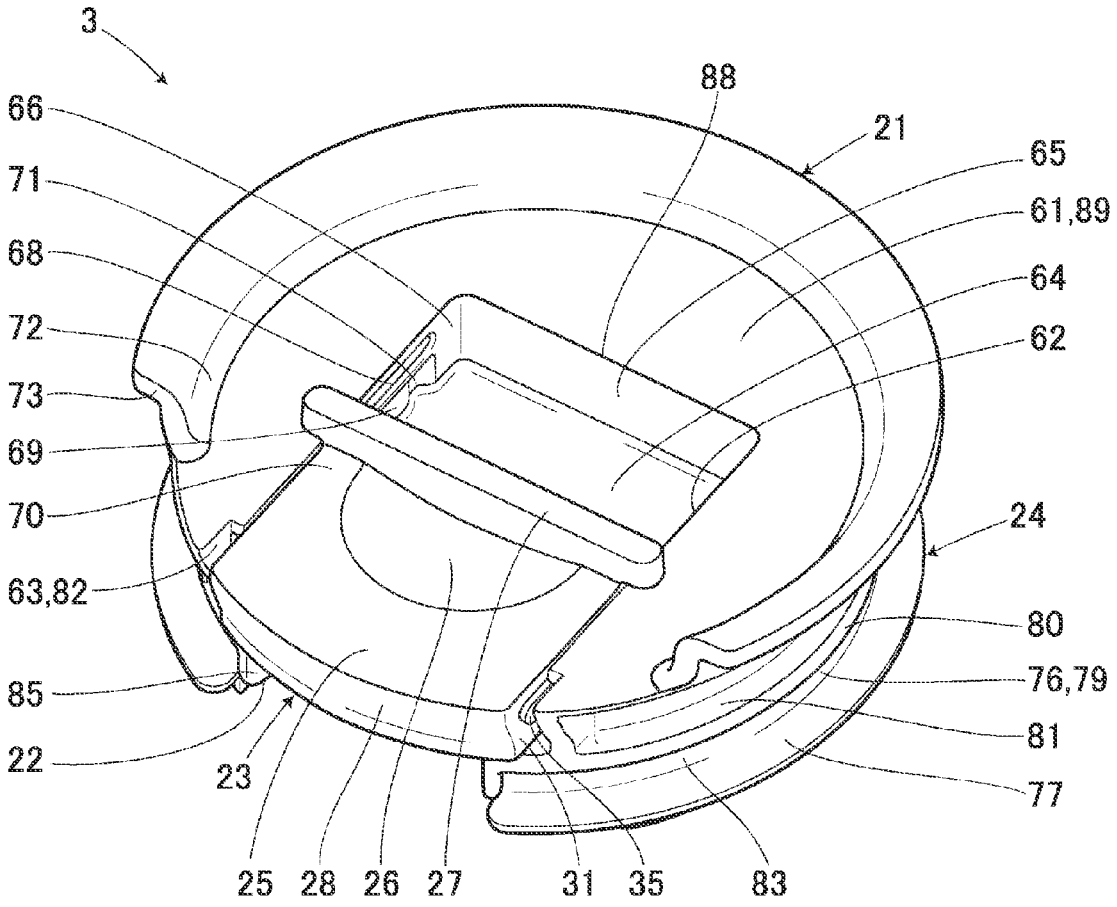
FIG. 8 is a perspective view of the lid that is shown in FIG. 1.

In addition, as shown in FIG. 6, when an attempt is mistakenly made to install the sliding cap 23 onto the cap main body 21 from the front wall 28, since the front wall 28 abuts against the front side surface part 87 of the incorrect insertion prevention projection 33, it is not possible to push the sliding cap 23 to the sliding engagement part 62 of the cap main body 21.

Furthermore, even if an attempt is made to install the sliding cap 23 from the top of the sliding engagement part 62 by pushing the sliding cap 23, it is not possible to push the sliding cap 23 since a length between the left and right sliding engagement ribs 35 and 35 is longer than a width of the sliding engagement part 62.

When the back wall 29 of the sliding cap 23 is in a position of abutting against the back side wall 65 of the cap main body 21, the front wall 28 of the sliding cap 23 is positioned further to the front side than the incorrect insertion prevention projection 33, and therefore, the front wall 28 does not come into contact with the incorrect insertion prevention projection 33.

Next, the installation of the liquid stopping member 24 to the cap main body 21 will be described in detail.

Firstly, the back part tab 50 of the liquid stopping member 24 is inserted into the tab disposition part 78 that is formed in the cap main body 21, and the ring part 41 engages with the liquid stopping member engagement part 83. Further, the U-shaped upper side surface 44 that has a smooth bottom surface engages along the external side surfaces of the hole back wall 84, the hole left wall 85, and the hole right wall 86 that are provided in the cap main body 21 while abutting against a bottom surface part lower surface 90, which is a lower side surface of the bottom surface part 64.

Additionally, since the liquid stopping member 24 is flexible, it can be attached and detached easily with respect to any location.

In addition, in a case in which an attempt is mistakenly made to engage the liquid stopping member 24 in a vertically inverted manner, since the back part tab lower surface 51 and the ring part lower surface 52 are formed to be flush with one another, the back part tab 50 interferes with the lower wall 76, and therefore, the ring part 41 cannot engage with the liquid stopping member engagement part 83. As a result of this, it is possible for a user to recognize that the top and bottom of the liquid stopping member 24 are inverted.

Next, the installation of the lid 3 onto the beverage container main body 1 will be described in detail.

Firstly, the beverage container main body 1 is filled with a desired beverage in advance. The sliding cap 23 and the liquid stopping member 24 are engaged with the cap main body 21. At this time, the clicking rib 40 is set to a closed state of being engaged with the front clicking reception part 70 so that the sliding cap 23 does not interfere with the upper end surface 74 of the beverage container main body 1. Further, when the lid 3 is pushed from the top of the upper aperture part 2 of the beverage container main body 1 toward the bottom thereof, the tongue piece part 47 of the liquid stopping member 24 comes into close contact with an inner surface of the beverage container main body 1. Furthermore, when the lid 3 is pushed down until the upper end surface 74 of the beverage container main body 1 abuts against the container reception part 73, the front wall 28 of the sliding cap 23 abuts against the inner surface part 32 of the beverage container main body 1, and the lid 3 engages with the beverage container main body 1 completely.

In this manner, by installing the lid 3, in addition to improving a temperature maintenance effect inside the beverage container main body 1, it is possible to prevent the falling and invasion of dust or the like into the beverage container main body 1.

In order to detach the lid 3 from the beverage container main body 1, it is sufficient to grasp the container reception part 73 of the cap main body 21 while holding the beverage container main body 1, and pull the lid 3 upward.

The flow of air inside the beverage container during attachment and detachment of the lid 3 will be described in detail.

Figure 9:
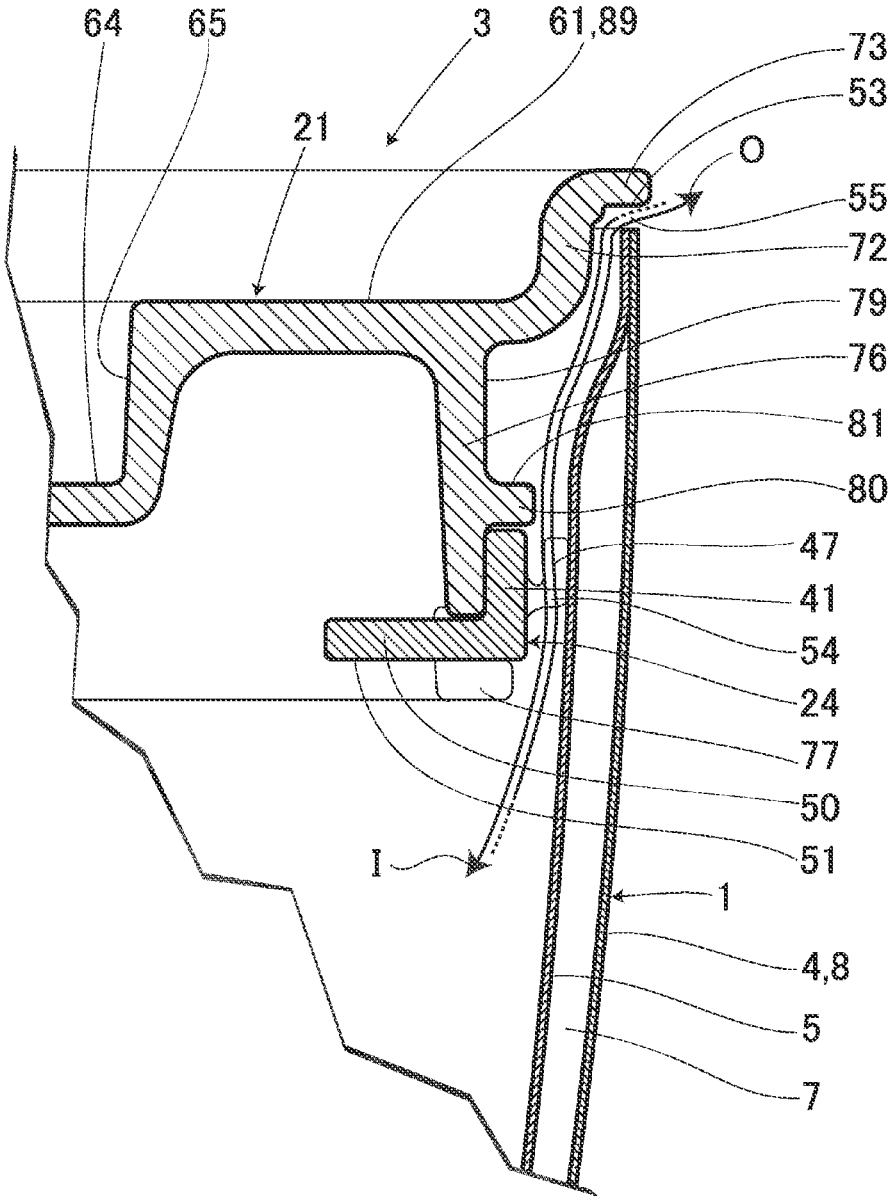
FIG. 9 is a longitudinal cross-sectional view that shows a main part of the lid that is shown in FIG. 1.

The arrows I and O in FIG. 9 show the flow of air during attachment and detachment of the lid 3 in a closed state of the sliding cap 23.

When the lid 3 is pushed onto the beverage container main body 1, as shown by the arrow O, the air inside the beverage container passes through a first airflow path 54 that is formed between the tongue piece notched part 49 that is formed in the liquid stopping member 24 and an inner surface of the inner container 5, and is ejected outside the beverage container via a second airflow path 55 that is formed between the stepped part for air flow 53 and the upper end surface 74.

In addition, as shown by the arrow I, when the lid 3 is pulled from the beverage container main body 1, air is taken in via the second airflow path 55, passes through the first airflow path 54, and reaches the inside of the beverage container.

In this manner, by forming the first airflow path 54 and the second airflow path 55, the coming and going of air inside the beverage container occurs smoothly in a closed state, and therefore, it is possible to easily perform the attachment and detachment of the lid 3 without receiving resistance due to air pressure.

Additionally, in a case in which the lid 3 is attached or detached in an open state, air comes in and goes out via the liquid through-hole 22.

After the lid 3 has been installed onto the beverage container main body 1, it is possible to perform opening and closing of the liquid through-hole 22 by sliding the sliding cap 23 forward and back so that the clicking rib 40 reciprocates between the front clicking reception part 70 and the back clicking reception part 71 that are formed in the lower sliding groove 69. When the sliding cap 23 slides, the manipulation bar 27 is operated by holding the manipulation bar 27.

When the liquid through-hole 22 is opened with the sliding cap 23 in an open state, a drinking aperture part 91 is formed by the inner surface of the beverage container main body 1 and the liquid through-hole 22, and it is possible to drink a beverage with which the beverage container main body 1 is filled via the drinking aperture part 91 in the beverage container main body 1. There are no components that would hinder a flow path of a beverage before reaching the drinking aperture part 91, and therefore, it is possible to drink the entire contents without a beverage remaining inside the beverage container main body 1.

In the present example, a lid for a beverage container includes a cap main body 21 that attaches to an upper aperture part 2 of a beverage container main body 1 and includes a liquid through-hole 22, and a sliding cap 23 that is installed on the cap main body 21 in a detachable manner by engaging in a sliding manner, and that opens and closes the liquid through-hole 22 by sliding. An elastic clicking part 40 is provided on side surfaces 30 and 31 of the sliding cap 23, clicking reception parts 70 and 71 are provided in the cap main body 21, and the sliding cap 23 is held by the cap main body 21 when the elastic clicking part 40 engages with the clicking reception parts 70 and 71.

Therefore, it is possible to attach and detach the sliding cap 23 with respect to the cap main body 21, and therefore, cleaning properties are improved.

In addition, by engaging the clicking rib 40 that is formed in the sliding cap 23 with the clicking reception parts 70 and 71 that are formed in the cap main body 21, it is possible to reliably hold the liquid through-hole 22 at an opening and closing position thereof.

In addition, since the clicking rib 40 is formed by notching a part of the side surfaces 30 and 31 of the sliding cap 23, it is possible to make the clicking rib 40 elastic, and therefore, it is possible to more reliably perceive a clicking feeling.

In addition, the notched part 34 is formed in the back wall 29 of the sliding cap 23, the positioning projection 33 is provided in the cap main body 21, the positioning projection 33 passes through the notched part 34 when the sliding cap 23 engages with the cap main body 21, and the engagement between the sliding cap 23 and the cap main body 21 in a sliding manner is not possible due to the positioning projection 33 interfering with the sliding cap 23 in a case in which the sliding cap 23 is backwards. As a result of this, it is possible to prevent incorrect installation of the sliding cap 23 to the cap main body 21.

In addition, when the lid 3 is installed onto the beverage container main body 1, since the liquid stopping member 24 closely engages with the inner surface of the beverage container main body 1, it is possible to reliably engage the lid 3 with the beverage container main body 1.

Additionally, the present invention is not limited to the abovementioned example, and various modification examples are possible within a range of the scope of the present disclosure.

For example, in the example, the clicking reception parts were formed in two locations, but the positions at which the clicking ribs that are formed in sliding cap engage may be set as three or more.

In addition, in the example, the clicking reception part is formed in the sliding cap, and the clicking part is formed in the cap main body.

While preferred embodiments of the disclosure have been described and illustrated above, it should be understood that these are exemplary of the disclosure and are not to be considered as limiting. Additions, omissions, substitutions, and other modifications can be made without departing from the spirit or scope of the present disclosure. Accordingly, the disclosure is not to be considered as being limited by the foregoing description, and is only limited by the scope of the appended claims.

EXPLANATION OF REFERENCES

1 beverage container main body
2 upper aperture part
21 cap main body
22 liquid through-hole
23 sliding cap
29 back wall (back surface of sliding cap)
30 left wall (side surface of sliding cap)
31 right wall (side surface of sliding cap)
33 incorrect insertion prevention projection (positioning projection)
34 incorrect insertion prevention notched part (notched part)
40 clicking rib (elastic clicking part)
70 front clicking part (clicking reception part)
71 back clicking part (clicking reception part)

What is claimed is:

1. A lid for a beverage container comprising:

a cap main body that attaches to an upper aperture part of a beverage container main body and comprises a liquid through-hole;

a sliding cap that is installed on the cap main body in a detachable manner by engaging in a sliding manner, and the sliding cap opens and closes the liquid through-hole by sliding;

wherein an elastic clicking part is provided on side surfaces of the sliding cap;

a clicking reception part is formed in the cap main body; and, the sliding cap is held by the cap main body when the elastic clicking part engages with the clicking reception part; wherein a notched part is formed on a back surface of the sliding cap;

a positioning projection is provided in the cap main body;

the positioning projection passes through the notched part when the sliding cap engages with the cap main body, and the engagement between the sliding cap and the cap main body in a sliding manner is not possible due to the positioning projection interfering with the sliding cap in a case in which the sliding cap is backwards.

2. The lid for a beverage container according to claim 1, wherein the elastic clicking part is formed by notching a part of the side surface of the sliding cap.

3. The lid for a beverage container according to claim 1, wherein the liquid through-hole when open, is adjacent to an outer side of the cap main body.

4. The lid for a beverage container according to claim 1, wherein multiple clicking reception parts are formed in the cap main body.

5. A beverage container comprising the lid according to claim 1.

6. Currently Amended) A lid for a beverage container comprising:

a cap main body that attaches to an upper aperture part of a beverage container main body and comprises a liquid through-hole;

a sliding cap that is installed on the cap main body in a detachable manner by engaging in a sliding manner, and the sliding cap opens and closes the liquid through-hole by sliding to cover the liquid through-hole;

wherein elastic projections are provided on side surfaces of the sliding cap;

reception notches are formed in the cap main body; and, the sliding cap is held by the cap main body when the elastic projections engage with the reception notches; wherein a notched part is formed on a back surface of the sliding cap;

a positioning projection is provided in the cap main body;

the positioning projection passes through the notched part when the sliding cap engages with the cap main body, and the engagement between the sliding cap and the cap main body in a sliding manner is not possible due to the positioning projection interfering with the sliding cap in a case in which the sliding cap is backwards.

7. The lid for a beverage container according to claim 6, wherein the elastic projections engage with the reception notches and emit an audible sound, a vibration, or a tactile sensation.

8. A beverage container comprising the lid according to claim 6.

* * * * *